US011885589B2

(12) United States Patent
Yücel

(10) Patent No.: US 11,885,589 B2
(45) Date of Patent: Jan. 30, 2024

(54) FOLDABLE PUMP-ACTION RIFLE

(71) Applicant: KAIZEN ARMS İMALAT İTHALAT VE İHRACAT SANAYİ TİCARET LİMİTED ŞİRKETİ, Beyşehir (TR)

(72) Inventor: Ferhat Yücel, Beyşehir (TR)

(73) Assignee: KKAIZEN ARMS İMALAT İTHALAT VE İHRACAT SANAYİ TİCARET LİMİTED ŞİRKETİ, Beyşehir (TR)

( * ) Notice: Subject to any disclaimer, the term of this patent is extended or adjusted under 35 U.S.C. 154(b) by 0 days.

(21) Appl. No.: 17/743,212

(22) Filed: May 12, 2022

(65) Prior Publication Data

US 2023/0092713 A1 Mar. 23, 2023

(30) Foreign Application Priority Data

Sep. 20, 2021 (TR) ..... 2021-014699

(51) Int. Cl.
*F41C 23/04* (2006.01)
*F41C 7/02* (2006.01)

(52) U.S. Cl.
CPC ..... *F41C 23/04* (2013.01); *F41C 7/02* (2013.01)

(58) Field of Classification Search
CPC .... F41A 3/72; F41A 3/66; F41C 23/04; F41C 23/16; F41G 11/003
USPC ..... 42/16, 73, 84, 71.01, 72, 75.01; 89/193, 89/191.02
See application file for complete search history.

(56) References Cited

U.S. PATENT DOCUMENTS 2,400,349 A * 5/1946 Haberstump ..... F41C 23/04 42/72
2,405,758 A * 8/1946 Sampson ..... F41C 23/04 42/72
2,628,536 A * 2/1953 Schaich ..... F41A 3/44 89/137
2,861,374 A * 11/1958 Hampton ..... F41A 15/14 89/190
3,798,819 A * 3/1974 Hillberg ..... F41C 23/04 42/71.01
4,044,487 A * 8/1977 Hutton ..... F41A 35/02 42/16
4,867,039 A * 9/1989 Dobbins ..... F41C 7/02 89/146
4,905,395 A * 3/1990 Wagner ..... F41A 9/72 42/17
5,068,992 A * 12/1991 Velezis ..... F41A 35/06 42/72
6,490,822 B1 * 12/2002 Swan ..... F41C 23/16 42/75.01
6,671,990 B1 * 1/2004 Booth ..... F41G 11/003 42/75.01
6,782,652 B1 * 8/2004 Erickson ..... F41A 35/02 42/143
6,782,791 B2 * 8/2004 Moore ..... F41A 17/46 89/44.01

(Continued)

*Primary Examiner* — Michael D David
(74) *Attorney, Agent, or Firm* — Polson Intellectual Property Law, PC; Margaret Polson; Christopher Sylvain

(57) ABSTRACT

A foldable pump-action shotgun is disclosed to enable the pump-action shotgun used in hunting to be created in a folding structure, thus providing ease of carriage, wherein the feeding/unloading process of the cartridge is provided.

8 Claims, 6 Drawing Sheets

(56) References Cited

U.S. PATENT DOCUMENTS 7,337,574 B2 * 3/2008 Crandall ..... F41C 23/04 89/160
7,493,718 B2 * 2/2009 Gorzen ..... F41A 3/10 42/74
7,610,844 B2 * 11/2009 Kuczynko ..... F41A 5/28 89/193
7,634,959 B2 * 12/2009 Frickey ..... F41C 7/025 89/149
7,661,220 B2 * 2/2010 Crandall ..... F41A 19/18 42/69.03
7,775,150 B2 * 8/2010 Hochstrate ..... F41A 5/18 89/193
7,934,447 B2 * 5/2011 Kuczynko ..... F41A 5/28 89/193
7,938,055 B2 * 5/2011 Hochstrate ..... F41A 5/18 89/193
8,117,958 B2 * 2/2012 Hochstrate ..... F41C 23/16 89/193
8,393,107 B2 * 3/2013 Brown ..... F41C 27/00 42/105
8,505,433 B2 * 8/2013 Hochstrate ..... F41A 11/02 89/193
8,631,601 B2 * 1/2014 Langevin ..... F41C 23/04 42/73
8,726,557 B2 * 5/2014 Stone ..... F41C 23/16 42/71.01
8,783,160 B2 * 7/2014 Hochstrate ..... F41A 5/18 89/193
8,943,948 B2 * 2/2015 Kuczynko ..... F41A 5/28 89/193
9,347,737 B2 * 5/2016 Troy ..... F41C 7/02
9,739,565 B2 * 8/2017 Kielsmeier ..... F41C 23/20
9,851,175 B2 * 12/2017 Leasure ..... F41C 23/16
2006/0065112 A1 * 3/2006 Kuczynko ..... F41A 5/28 89/193
2006/0260169 A1 * 11/2006 Samson ..... F41C 23/16 42/72
2007/0033851 A1 * 2/2007 Hochstrate ..... F41A 5/18 42/75.01
2007/0199225 A1 * 8/2007 Haugen ..... F41G 11/003 42/85
2007/0199435 A1 * 8/2007 Hochstrate ..... F41G 11/003 42/72
2010/0095834 A1 * 4/2010 Kuczynko ..... F41A 5/28 89/193
2010/0300277 A1 * 12/2010 Hochstrate ..... F41C 23/16 42/71.01
2010/0319231 A1 * 12/2010 Stone ..... F41C 23/00 42/75.01
2011/0225865 A1 * 9/2011 Williams ..... F41C 23/16 42/90
2011/0247254 A1 * 10/2011 Barnes ..... F41A 21/48 42/75.01
2011/0265640 A1 * 11/2011 Kuczynko ..... F41A 5/28 89/193
2011/0275435 A1 * 11/2011 Torre ..... A63F 13/245 463/37
2011/0283582 A1 * 11/2011 Hunter ..... F41C 23/00 42/69.01
2012/0137561 A1 * 6/2012 Ludlow ..... F41C 23/04 42/75.03
2012/0137562 A1 * 6/2012 Langevin ..... F41C 23/04 42/75.03
2012/0137872 A1 * 6/2012 Crommett ..... F41A 5/26 89/193
2012/0204466 A1 * 8/2012 Bayne ..... F41H 13/0018 42/84
2012/0297970 A1 * 11/2012 Langevin ..... F41A 3/66 42/14
2013/0212920 A1 * 8/2013 Law ..... F41C 23/14 42/75.03
2014/0196345 A1 * 7/2014 Grimshaw ..... F41C 23/04 42/73
2014/0196346 A1 * 7/2014 Grimshaw ..... F41C 23/04 42/73
2014/0311004 A1 * 10/2014 Barrett ..... F41A 17/42 42/16
2015/0113848 A1 * 4/2015 Monveldt ..... F41A 35/06 42/16
2021/0215451 A1 * 7/2021 Ding ..... F41C 23/14
2023/0092713 A1 * 3/2023 Yücel ..... F41C 7/02

* cited by examiner

FOLDABLE PUMP-ACTION RIFLE

CROSS REFERENCE APPLICATIONS

This application is a non-provisional application claiming priority to Turkish application 2021/014699 filed Sep. 20, 2021, which is hereby incorporated by reference for all purposes.

BACKGROUND

Presently, different types of shotguns are used in hunting, such as single barrel, side-by-side double-barreled, over/under double-barreled superposed and pump-action shotguns.

In the state of the art, single-barreled, side-by-side and over/under double-barreled shotguns can be collapsed by folding such that the cartridges can be fed/unloaded manually. However, pump-action shotguns cannot be folded by collapsing. For this reason, since the shotgun cannot be collapsed by folding, the transportation is realized in a very difficult way.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

An aspect of the disclosure is to realize a foldable pump-action shotgun which has been developed to enable the pump-action shotgun used in hunting to be created in a folding structure, thus providing ease of carriage, wherein the feeding/unloading process of the cartridge is provided by folding a lower body and an upper body on an axis of the main screw connected to a folding center formed in the lower body and the upper body, wherein the shotgun is positioned in a bag in a folded state in the folding process except for the cartridge feeding/unloading process and, in this way, can be easily transported as it takes up less space, and wherein the shotgun is used by positioning a locking pin in a locking clearance of the upper body after the lower body and the upper body are brought into a straight form on the axis of the folding center for the shooting position.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
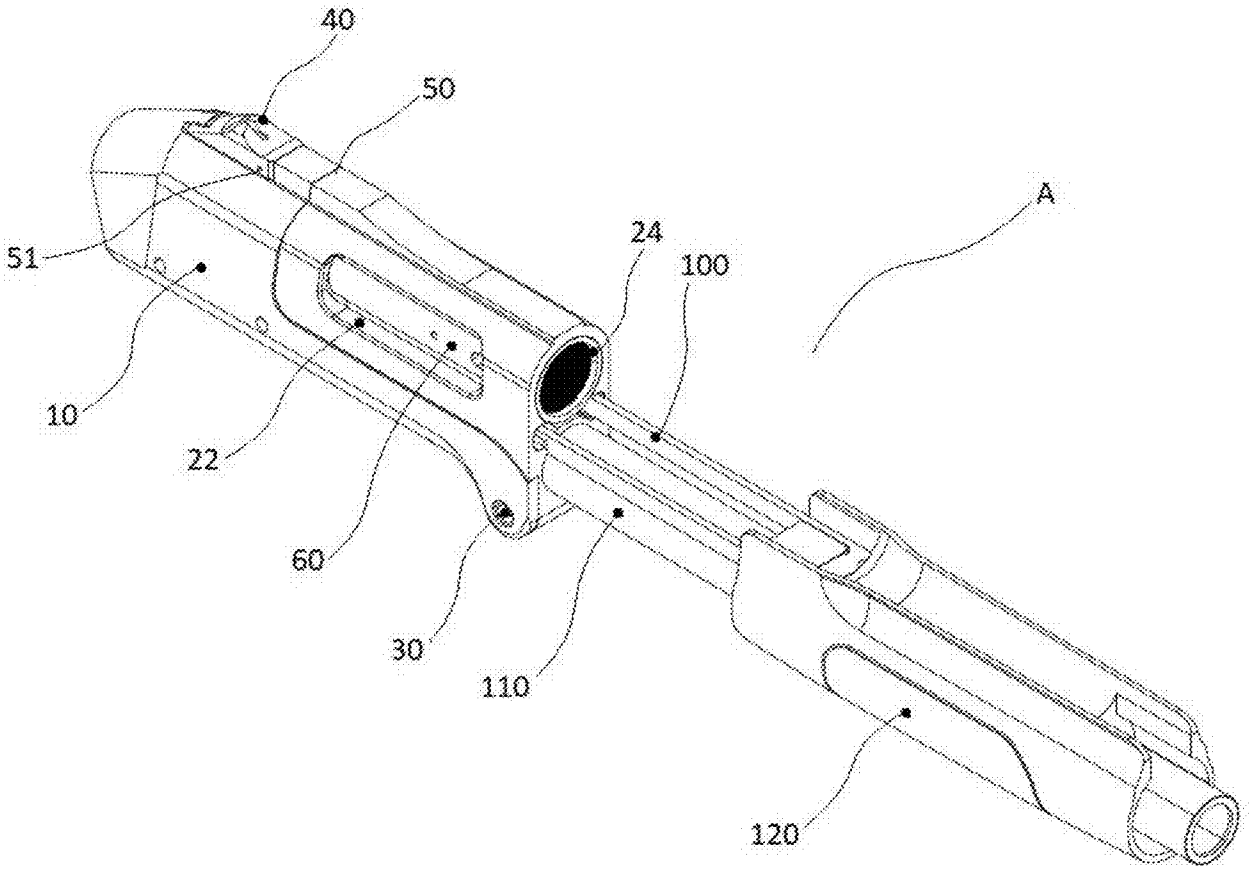
FIG. 1 shows a representative view of the foldable pump-action shotgun, with the parts assembled other than the butt, the barrel and the magazine.

FIG. 1 shows a representative view of the foldable pump-action shotgun (A) used in hunting, with the parts assembled other than the butt, the barrel and the magazine.

The foldable pump-action shotgun (A) consists of:

- a lower body (10) which has a folding center (11) in the lower part thereof and a slide (12), a slot (13) and a lock running clearance (14) in the upper rear part thereof,
- an upper body (20) connected to the lower body (10), which has a folding center (11) in the lower front part thereof, a mechanism running clearance (21) in the inner part thereof, a window (22) in the lateral part thereof, a magazine tube connection (23) in the lower front part thereof, a barrel connection (24) in the upper front part thereof, and a locking clearance (25) in the upper back part thereof,
- a main screw (30) connected to the folding center (11), which connects the lower body (10) and the upper body (20) to each other, and also which enables the upper body (20) to be folded/collapsed on the lower body (10),
- a locking pin (50) connected to the front part of the back sight (40) for aiming by means of the fixing pin (51), which enables the separation of the upper body (20) connected on the lower body (10) in the folding process of the shotgun (A), as well as the fixation by bringing the upper body (20) into a straight form on the lower body (10),
- a cap (60) and a mechanism (70), which are connected to the mechanism running clearance (21) formed in the upper body (20),
- a lower holder (80) and a rear holder (90), which enable the fixation of the cartridge (F) in the magazine tube (110).
- a pump handle (100) which moves the rear holder (90) forward in order to ensure the mechanism (70) to be set up and also the rear holder (90) to be in the shooting position of the shotgun (A) while the cartridge (F) positioned in the magazine tube (110) remains in a fixed position,
- a magazine tube (110) by means of which the cartridges (F) are positioned therein and a forend (120) connected to the magazine tube (110).

Figure 2:
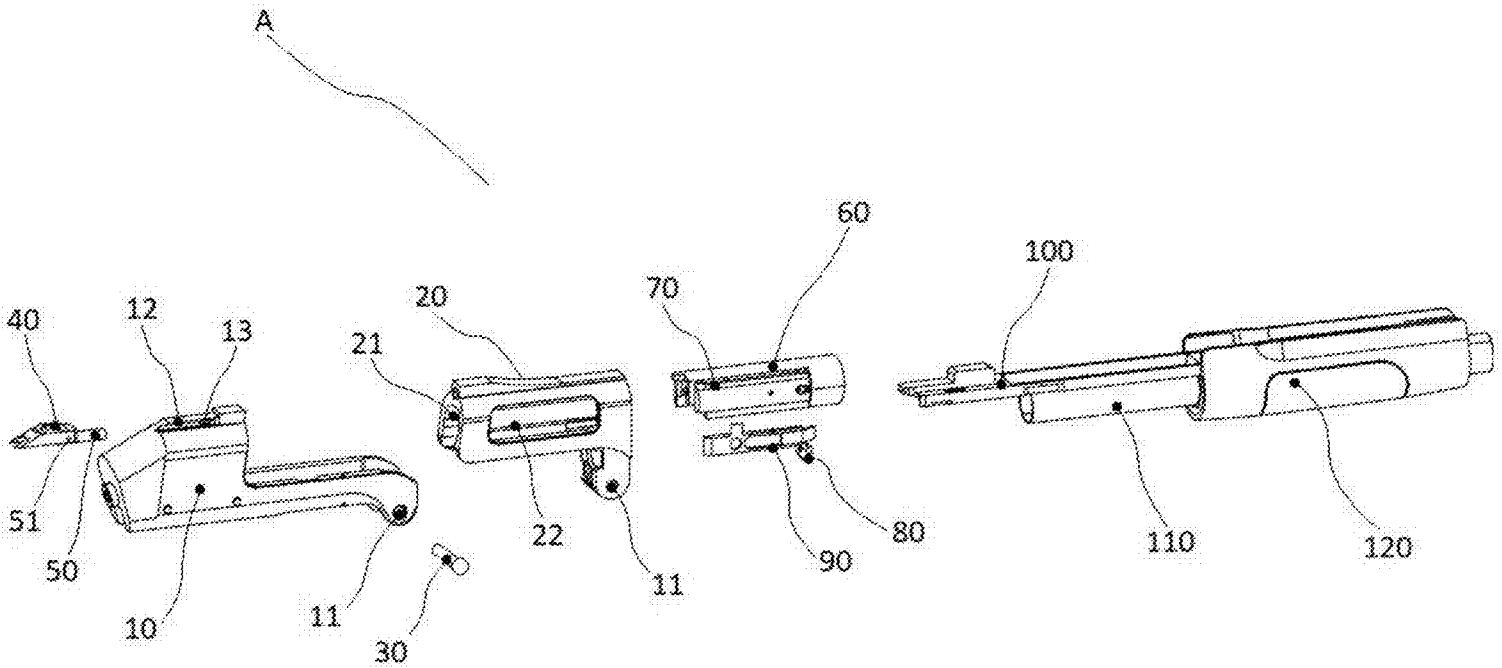
FIG. 2 shows a representative view of the foldable pump-action shotgun, with the parts disassembled other than the butt, the barrel and the magazine.
Figure 3:
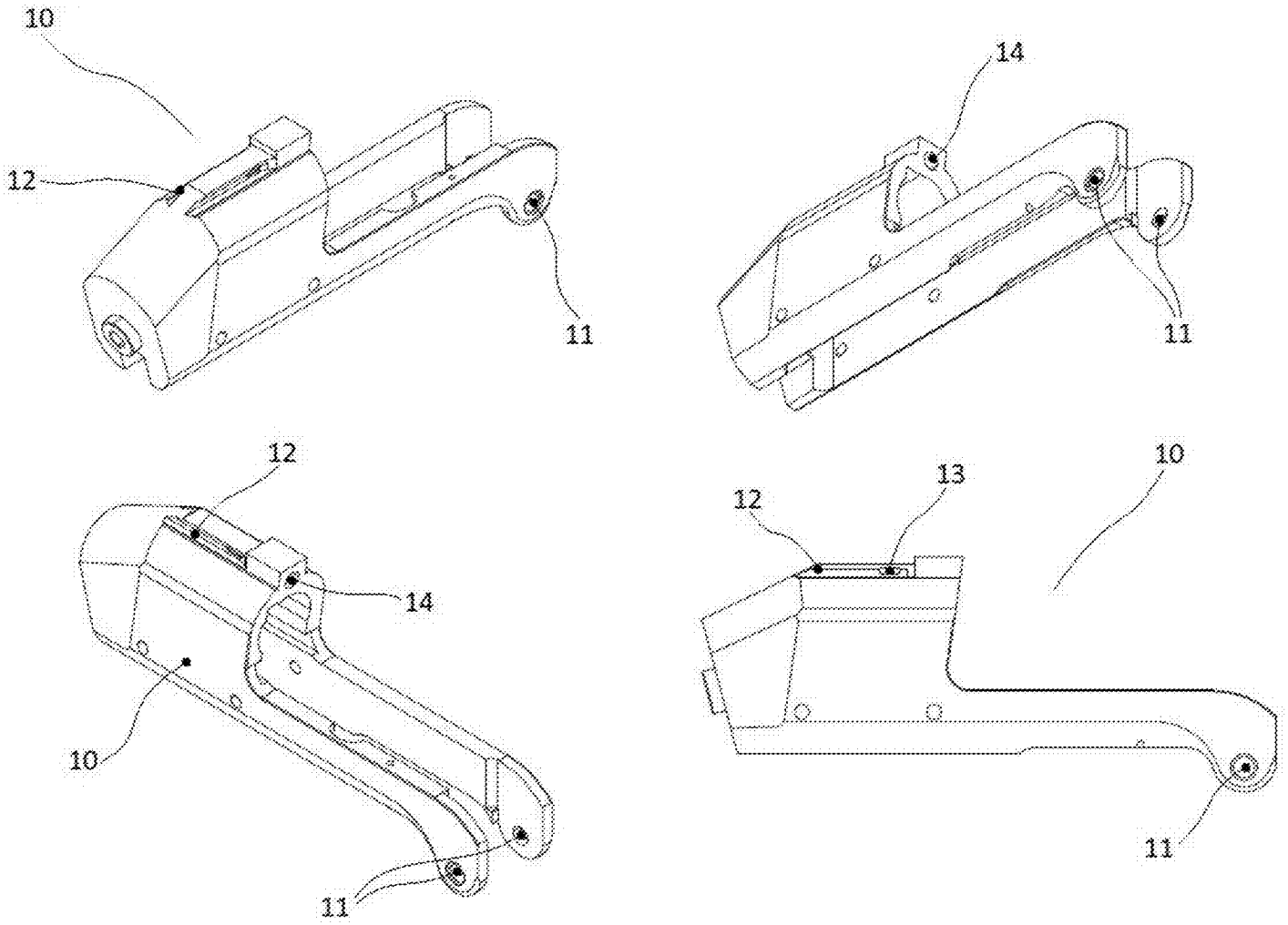
FIG. 3 shows representative views of the lower body of the foldable pump-action shotgun from different angles.
Figure 4:
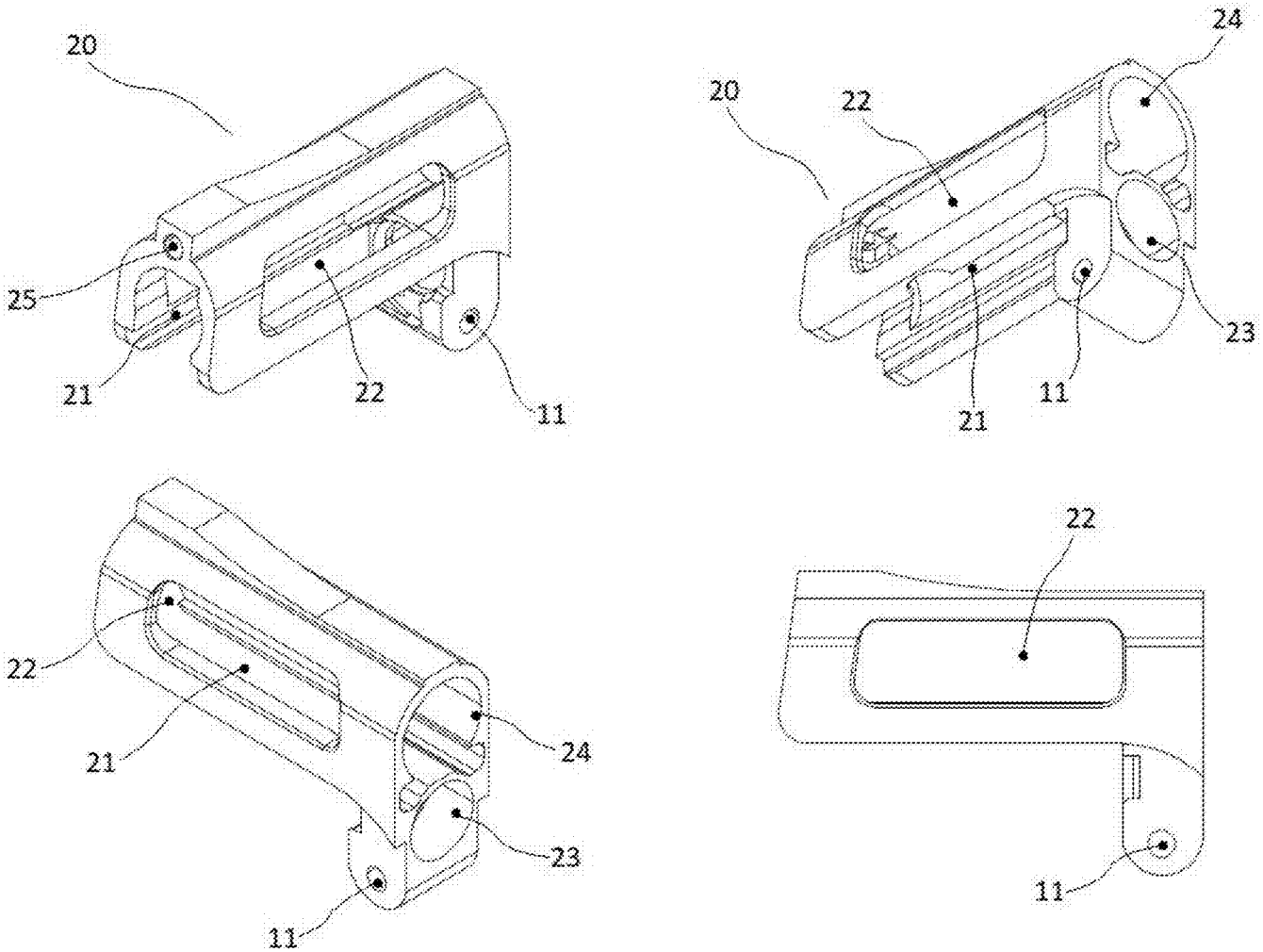
FIG. 4 shows representative views of the upper body of the foldable pump-action shotgun from different angles.

When assembling the foldable pump-action shotgun (A) of the invention, the parts manufactured as stated above are made as shown in FIG. 2, respectively. In this process, both the rear sight (40) and the locking pin (50) are connected to the lower body (10) by means of the fixing pin (51) passed through the slot (13) by positioning the back sight (40) onto the slide (12) located on the lower body (10) and the spring and the locking pin (50) into the lock running clearance (14). Subsequently, the folding centers (11) of the lower body (10) and the upper body (20) are aligned, and the assembly process of the main screw (30) is performed.

The cap (60), the mechanism (70), the lower holder (80), and the rear holder (90) are positioned into the mechanism running clearance (21) located in the upper body (20). At this stage, it is connected to the mechanism (70) and the rear holder (90) by passing the pump arm (100) inwardly through the front part of the upper body (20). Finally, the magazine tube (110), the forend (120), the barrel, the butt and the magazine are assembled, and the assembly process is completed.

Figure 5:
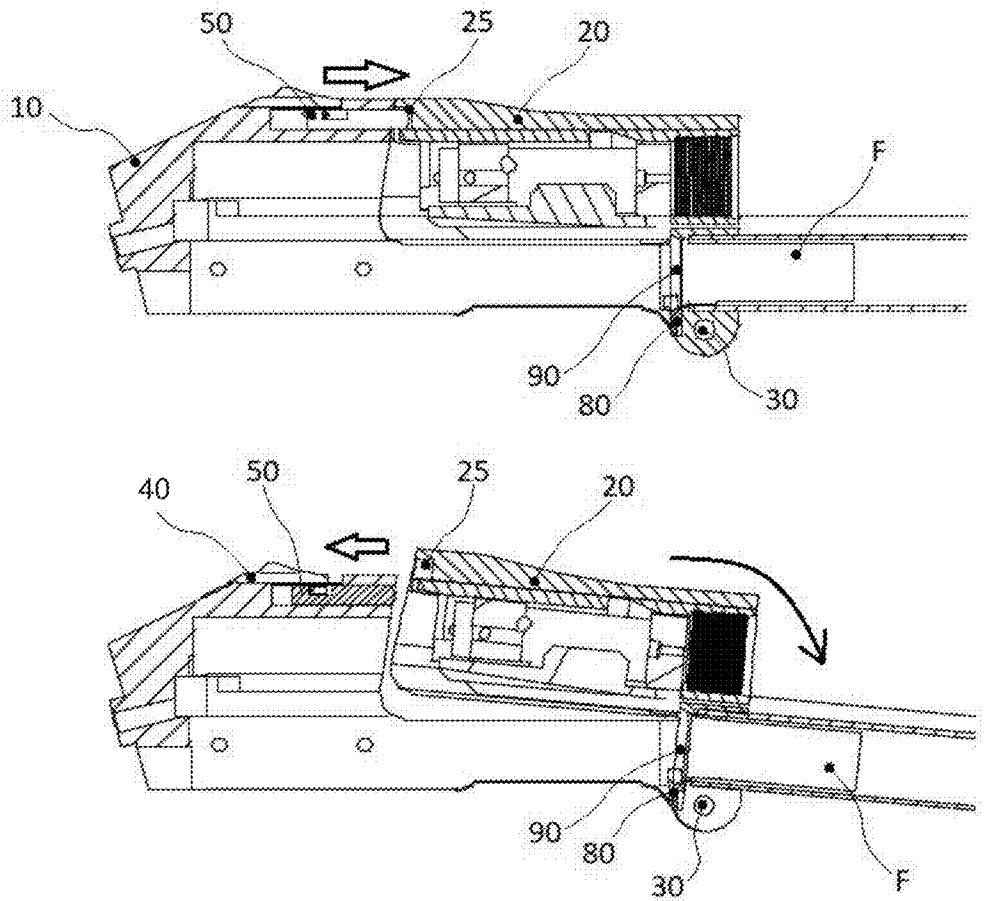
FIGS. 5 and 6 show representative views of the folding of the pump-action shotgun.
Figure 6:
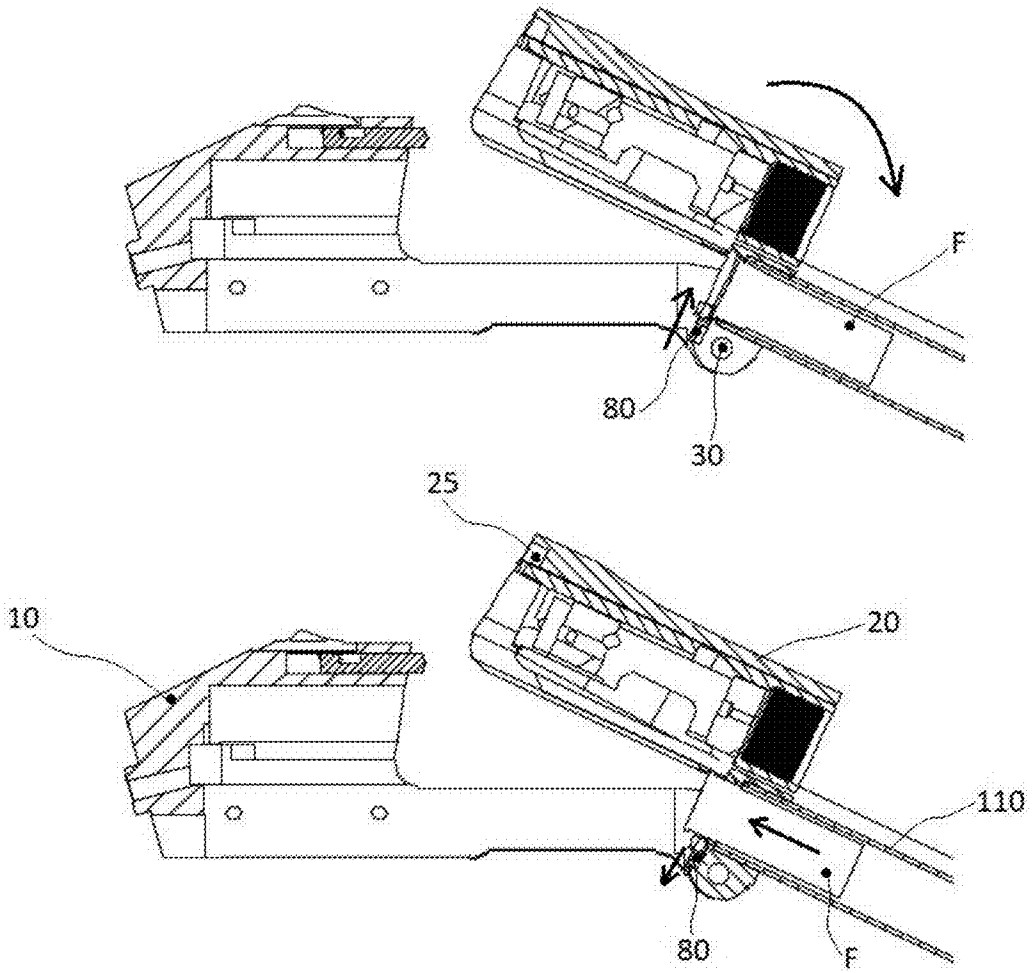

In FIGS. 5 and 6, the folding/collapsing process of the foldable pump-action shotgun (A) of the invention is shown. Accordingly, the pump-action shotgun (A) in the straight position before or after shooting (see FIG. 5, top view) needs to be collapsed for the cartridge feeding/unloading process. In this process, the rear sight (40) is moved backwardly, so that the locking pin (50) is separated from the lock running clearance (14). At this stage, the upper body (20) is folded/collapsed in the front downward direction on the axis of the main screw (30) in the front part of the lower body (10) (see bottom view in FIG. 5 and top view in FIG. 6).

The cartridge (F) is not separated from the magazine tube (110) at this stage. It is ensured that the lower holder (80) in the form of a spring is moved downwards by a user and the cartridge (F) head is released from the lower holder (80), in order to take the cartridge (F) from the magazine tube (110) (see bottom view in FIG. 6). In this way, the cartridge (F) is taken from the magazine tube (110), and a new cartridge (F) can be connected to the magazine tube (110). The folded/collapsed pump-action shotgun (A) is returned to its straight form, and the pump-action shotgun (A) is straightened and thus brought to the shooting position by passing the locking pin (50) into the locking clearance (25).

After folding the pump-action shotgun (A) of the invention as shown in FIG. 6, the pump-action shotgun (A) is positioned in a bag by providing a complete collapsing/folding process on the axis of the main screw (30) of the upper body (20) so as to be parallel to the lower part of the lower body (10). In this way, the pump-action shotgun (A), which takes up less space, can be carried easily.

While a number of exemplary aspects and embodiments have been discussed above, those of skill in the art will recognize certain modifications, permutations, additions and sub-combinations therefor. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general, the terms and phrases used herein have their art-recognized meaning, which can be found by reference to standard texts, journal references and contexts known to those skilled in the art. The above definitions are provided to clarify their specific use in the context of the invention.

All patents and publications mentioned in the specification are indicative of the levels of skill of those skilled in the art to which the invention pertains. All references cited herein are hereby incorporated by reference to the extent that there is no inconsistency with the disclosure of this specification. Some references provided herein are incorporated by reference herein to provide details concerning additional starting materials, additional methods of synthesis, additional methods of analysis and additional uses of the invention.

REFERENCE NUMERALS

A. Pump-action shotgun
10. Lower body
11. Folding center
12. Slide
13. Slot
14. Lock running clearance
20. Upper body
21. Mechanism running clearance
22. Window
23. Magazine tube connection
24. Barrel connection
25. Locking clearance
30. Main screw
40. Back sight
50. Locking pin
51. Fixing pin
60. Cap
70. Mechanism
80. Lower holder
90. Rear holder
100. Pump handle
110. Magazine tube
120. Forend
F. Cartridge

The invention claimed is:

1. A foldable pump-action shotgun providing ease of carriage, comprising:

a lower receiver body and an upper receiver body, wherein the upper receiver body has a magazine tube connection in a lower front part thereof for a magazine tube of the shotgun, and the upper receiver body has a barrel connection in an upper front part thereof for a barrel of the shotgun, wherein the lower receiver body and the upper receiver body are pivotably connected to one another about an axis of a main screw provided in a folding center formed in the lower receiver body and the upper receiver body, such that by pivoting the lower receiver body and the upper receiver body relative to each other, the shotgun is foldable between an open position for cartridge feeding/unloading and a closed position for shooting, wherein the folding center is located in a lower front part of the lower receiver body and in a lower front part of the upper receiver body, and wherein the folding center is arranged under an end of the magazine tube when the shotgun is in the closed position, wherein the upper receiver body has a locking clearance in an upper rear part thereof for receiving a locking pin carried by the lower receiver body, and wherein the locking pin is inserted into the locking clearance when the shotgun is in the closed position and the locking pin is moved out of the locking clearance when switching between the open and closed positions.

2. The foldable pump-action shotgun of claim 1, wherein the lower receiver body has a slide, a slot and a lock running clearance in an upper rear part thereof.

3. The foldable pump-action shotgun of claim 1, wherein the upper receiver body has a mechanism running clearance in an inner part thereof and an ejection window in a lateral part thereof.

4. The foldable pump-action shotgun of claim 1, wherein the lower receiver body and the upper receiver body are connected to each other by the main screw.

5. The foldable pump-action shotgun of claim 1, further comprising a rear sight for aiming connected to the lower receiver body, wherein the locking pin is connected to a front part of the rear sight via a fixing pin.

6. The foldable pump-action shotgun of claim 3, further comprising a cap and a mechanism positioned in the mechanism running clearance formed in the upper receiver body.

7. The foldable pump-action shotgun of claim 1, further comprising a lower holder for retaining a cartridge in a fixed position in the magazine tube when the shotgun is in the open position.

8. The foldable pump-action shotgun of claim 6, further comprising a pump handle which moves a rear holder forward in order to ensure the mechanism to be set up and also the rear holder to be in a shooting position of the shotgun while a cartridge positioned in the magazine tube remains in a fixed position.

* * * * *